US008302566B2

(12) United States Patent
Min

(10) Patent No.: US 8,302,566 B2
(45) Date of Patent: Nov. 6, 2012

(54) DUAL PIPE HEAT EXCHANGER OF INSTANTANEOUS BOILER FOR HOUSE HEATING AND HOT WATER AND BOILER

(75) Inventor: Tae-Sik Min, Dongjak-gu (KR)

(73) Assignee: Kyungdong Everon Co., Ltd., Chungcheongbuk-do (KR)

( * ) Notice: Subject to any disclaimer, the term of this patent is extended or adjusted under 35 U.S.C. 154(b) by 195 days.

(21) Appl. No.: 12/085,123

(22) PCT Filed: Mar. 10, 2006

(86) PCT No.: PCT/KR2006/000856

§ 371 (c)(1),
(2), (4) Date: May 16, 2008

(87) PCT Pub. No.: WO2007/058410

PCT Pub. Date: May 24, 2007

(65) Prior Publication Data

US 2009/0120623 A1 May 14, 2009

(30) Foreign Application Priority Data

Nov. 19, 2005 (KR) ..... 10-2005-0111017

(51) Int. Cl.
*F22B 1/18* (2006.01)

(52) U.S. Cl. ..... 122/31.1; 165/104.14; 165/164; 165/168

(58) Field of Classification Search ..... 122/20 B, 122/20 R, 31.1, 32, 40; 165/104.14, 104.19, 165/104.22, 164, 168
See application file for complete search history.

(56) References Cited

U.S. PATENT DOCUMENTS 3,603,379 A * 9/1971 Leonard, Jr. ..... 165/50
(Continued)

FOREIGN PATENT DOCUMENTS

JP 56-158772 11/1981
(Continued)

OTHER PUBLICATIONS

International Search Report for Application No. PCT/KR2006/000856, dated Jul. 28, 2006.

(Continued)

*Primary Examiner* — Gregory A Wilson
(74) *Attorney, Agent, or Firm* — Nelson Mullins Riley & Scarborough LLP; Anthony A. Laurentano

(57) ABSTRACT

Disclosed are an instantaneous boiler and a double pipe heat exchanger for the instantaneous boiler supplying heating water and hot water, which can obtain hot water output larger than heating water output, simultaneously use the heating water and the hot water, and have a simple piping structure. The heat exchanger includes: an outer pipe used for a hot water pathway, to which combustion heat is directly transferred from a burner in a combustion chamber; and an inner pipe used for a heating water pathway and extending through the outer pipe. The boiler includes: a heat exchanger including an outer pipe used for hot water pathway, to which combustion heat is directly transferred from a burner in a combustion chamber, and an inner pipe used for heating water pathway, which extends through the outer pipe; a heating water supply pipe connected to the inner pipe of the heat exchanger; a heating water line connected to the heating water supply pipe; and a heating water returning pipe connected to the inner pipe, wherein the inner pipe of the heat exchanger, the heating water supply pipe, the heating water line, and the heating water returning pipe are connected to one another in series.

5 Claims, 3 Drawing Sheets

U.S. PATENT DOCUMENTS

| | | | | |
|---|---|---|---|---|
| 3,818,975 | A * | 6/1974 | Tokumitsu et al. | 165/95 |
| 3,907,026 | A * | 9/1975 | Mangus | 165/70 |
| 4,444,156 | A * | 4/1984 | Iwasaki et al. | 122/20 B |
| 4,492,093 | A * | 1/1985 | Schwarz | 62/238.6 |
| 5,732,769 | A * | 3/1998 | Staffa | 165/154 |
| 7,458,340 | B2 * | 12/2008 | Takeda et al. | 122/31.1 |
| 2009/0133642 | A1 * | 5/2009 | Asakura et al. | 122/32 |

FOREIGN PATENT DOCUMENTS

| | | |
|---|---|---|
| JP | 57-195014 | 12/1982 |
| JP | 2002-213757 | 7/2002 |
| KR | 10-1995-0011995 | 5/1995 |
| KR | 10-1997-0070823 | 11/1997 |
| KR | 0169884 | 1/1999 |
| KR | 10-2003-0097212 | 12/2003 |
| KR | 10-2005-0043438 | 5/2005 |
| KR | 10-2005-0043439 | 5/2005 |

OTHER PUBLICATIONS

Japanese Office Action for Application No. 2008-541060, dated Nov. 15, 2011.

* cited by examiner

DUAL PIPE HEAT EXCHANGER OF INSTANTANEOUS BOILER FOR HOUSE HEATING AND HOT WATER AND BOILER

TECHNICAL FIELD

The present invention relates to an instantaneous boiler and a double pipe heat exchanger for the instantaneous boiler supplying heating water and hot water, and more particularly to an instantaneous boiler and a double pipe heat exchanger for the instantaneous boiler supplying heating water and hot water, which can obtain hot water output larger than heating water output, simultaneously use the heating water and the hot water, and have a simple piping structure.

BACKGROUND ART

As known well, boilers have been used for heating rooms and supplying hot water at home or in public buildings. Generally, an instantaneous boiler is used for the supply of heating water and hot water. The instantaneous boiler is recognized to mainly supply heating water and additionally to supply hot water. However, with the improvement of adiabatic performance in houses, there is a tendency that the capacity of the boiler necessary for heating rooms is reduced, but the requirement for hot water supply increases.

Generally, the instantaneous boilers use a double pipe heat exchanger or a single pipe heat exchanger. The double pipe heat exchanger refers to one in which a hot water heat exchanging pipe is inserted into a heating water heat exchanger. The single pipe heat exchanger refers to one in which a hot water heat exchanger and a heating water heat exchanger are separately installed.

Since the double pipe heat exchanger has a compact size in comparison with the single pipe heat exchanger, it is possible to manufacture a boiler with a compact size and high heat efficiency, thereby reducing a manufacturing cost.

FIG. 1 is a view showing a configuration of a conventional boiler with a double pipe heat exchanger, and FIG. 2 is a view showing a configuration of a conventional boiler with a single pipe heat exchanger.

In the conventional boiler, a burner 20 is disposed at a lower portion of a combustion chamber 10. A heat exchanger 30 is installed at an upper portion of the burner 20. Therefore, heat energy generated from the burner 20 is transferred to the heat exchanger 30 including pipes through which water generally flows.

As shown in FIG. 1 attached hereto, the conventional double pipe heat exchanger includes an outer pipe 31 used for heating water pathway and an inner pipe 32 used for hot water pathway. In the conventional double pipe heat exchanger, combustion heat is firstly transferred from the burner 20 to the outer pipe 31 and then is secondly transferred to the inner pipe 32.

The conventional boiler with the double pipe heat exchanger has been designed in which a heating water line 50 is interrupted by means of a three-way valve 40 in order to rapidly supply hot water when a user uses the hot water so that combustion heat of the burner 20 is transferred to the inner pipe 32 through the outer pipe 31.

As shown in FIG. 2 attached hereto, the conventional boiler with the single pipe heat exchanger has a structure in that combustion heat of a burner 20 is transferred to a single pipe. In the conventional boiler, water of the single pipe is heated by means of the burner 20 and the flow of the water to a heating water line 50 is interrupted by a three-way valve 40 when a user uses hot water. At this time, an indirect heat exchanging line 70 is open so that the heated water flows to an indirect hot water heat exchanger 60.

Since the two conventional boilers have a structure in that a heating water pathway firstly absorbs the combustion heat of the burner 20, output of hot water is always lower than that of heating water. Further, if only hot water is used, a circulation pump 80 operates unnecessarily, thereby increasing consumption of electricity.

In addition, there is a problem in that an operation of heating rooms can be stopped during use of hot water. Further, since the three-way valve 40 is used for increasing the supply efficiency of the hot water, there is a problem in that the pipe arrangement is complicated, thereby increasing a manufacturing cost of the boiler.

DISCLOSURE OF INVENTION

Technical Problem

Accordingly, the present invention has been made to solve the above-mentioned problems occurring in the prior art, and it is an object of the present invention to provide an instantaneous boiler for supplying heating water and hot water and a double pipe heat exchanger for the boiler, which can obtain an output of hot water larger than an output of heating water, simultaneously supply heating water and hot water, and have a simple pipe arrangement structure without the use of a three-way valve.

Technical Solution

In order to accomplish the object of the present invention, there is provided a double pipe heat exchanger for an instantaneous boiler for supplying heating water and hot water, which comprises: an outer pipe used for a hot water pathway, to which combustion heat is directly transferred from a burner in a combustion chamber; and an inner pipe used for a heating water pathway and extending through the outer pipe.

Further, the outer pipe has a plurality of fins attached to a peripheral surface of the outer pipe.

Further, the inner pipe includes a straight type pipe, a multiple straight type pipe, a spiral type pipe, a coil type pipe, and a fin type pipe.

In order to accomplish the object of the present invention, there is provided an instantaneous boiler for supplying heating water and hot water, which comprises: a heat exchanger including an outer pipe used for hot water pathway, to which combustion heat is directly transferred from a burner in a combustion chamber, and an inner pipe used for heating water pathway, which extends through the outer pipe; a heating water supply pipe connected to the inner pipe of the heat exchanger; a heating water line connected to the heating water supply pipe; and a heating water returning pipe connected to the inner pipe, wherein the inner pipe of the heat exchanger, the heating water supply pipe, the heating water line, and the heating water returning pipe are connected to one another in series.

Advantageous Effects

In an instantaneous boiler for supplying heating water and hot water and a double pipe heat exchanger for the boiler according to the present invention, since the double pipe heat exchanger is provided with an outer pipe used for hot water pathway and an inner pipe used for heating water pathway, the boiler can obtain an output of hot water larger than an output of heating water, simultaneously supply heating water and hot water, and have a simple pipe arrangement without use of a three-way valve. Accordingly, there is an advantage of reducing a manufacturing cost.

BRIEF DESCRIPTION OF THE DRAWINGS

The foregoing and other objects, features and advantages of the present invention will become more apparent from the following detailed description when taken in conjunction with the accompanying drawings in which.

BEST MODE FOR CARRYING OUT THE INVENTION

Hereinafter, the preferred embodiment of the present invention will be described in detail with reference to the accompanying drawings.

Figure 3:
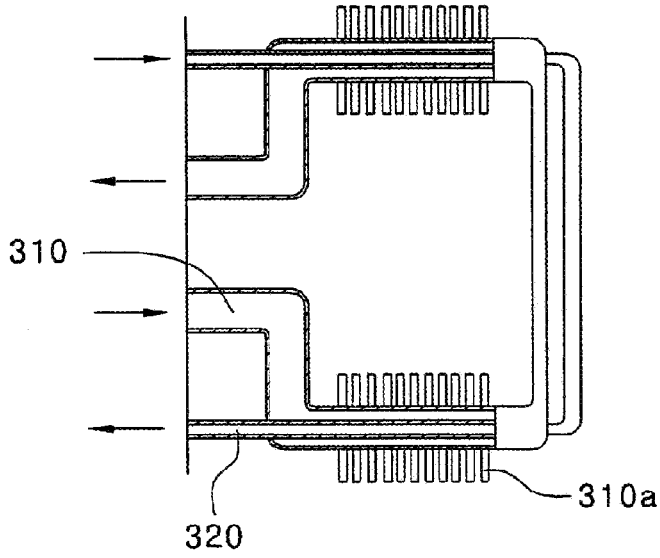
FIG. 3 is a sectional view showing a configuration of a double pipe heat exchanger for an instantaneous boiler for supplying heating water and hot water according to an embodiment of the present invention.

FIG. 3 is a sectional view showing a configuration of a double pipe heat exchanger for an instantaneous boiler for supplying heating water and hot water according to an embodiment of the present invention.

As shown in FIG. 3 attached hereto, the double pipe heat exchanger of the instantaneous boiler for supplying heating water and hot water according to an embodiment of the present invention includes an outer pipe 310 used for hot water pathway and an inner pipe 320 used for heating water pathway.

Since the double pipe heat exchanger has a structure in which the hot water pathway absorbs combustion heat of a burner 20, it is possible to manufacture a boiler having an output of heating water larger than an output of hot water. Such an output of hot water is adapted for requirements of current housing culture.

The boiler for supplying heating water and hot water is preferably designed to have the maximum output of hot water of 25,000 kcal/h, and the maximum output of heating water of 20,000 kcal/h.

The double pipe heat exchanger of the instantaneous boiler for supplying heating water and hot water according to the present invention preferably has one of a single straight type inner pipe, a multiple straight type inner pipe, a spiral type inner pipe, a coil type inner pipe, and a fin type inner pipe, so as to increase heat exchanging efficiency.

As shown in FIG. 3 attached hereto, the double pipe heat exchanger of the instantaneous boiler for supplying heating water and hot water according to the present invention preferably has an outer pipe 310 which has a plurality of fins 310*a* attached to a peripheral surface of the outer pipe 310 so as to increase a heating area absorbing combustion heat of the burner 20.

Figure 4:
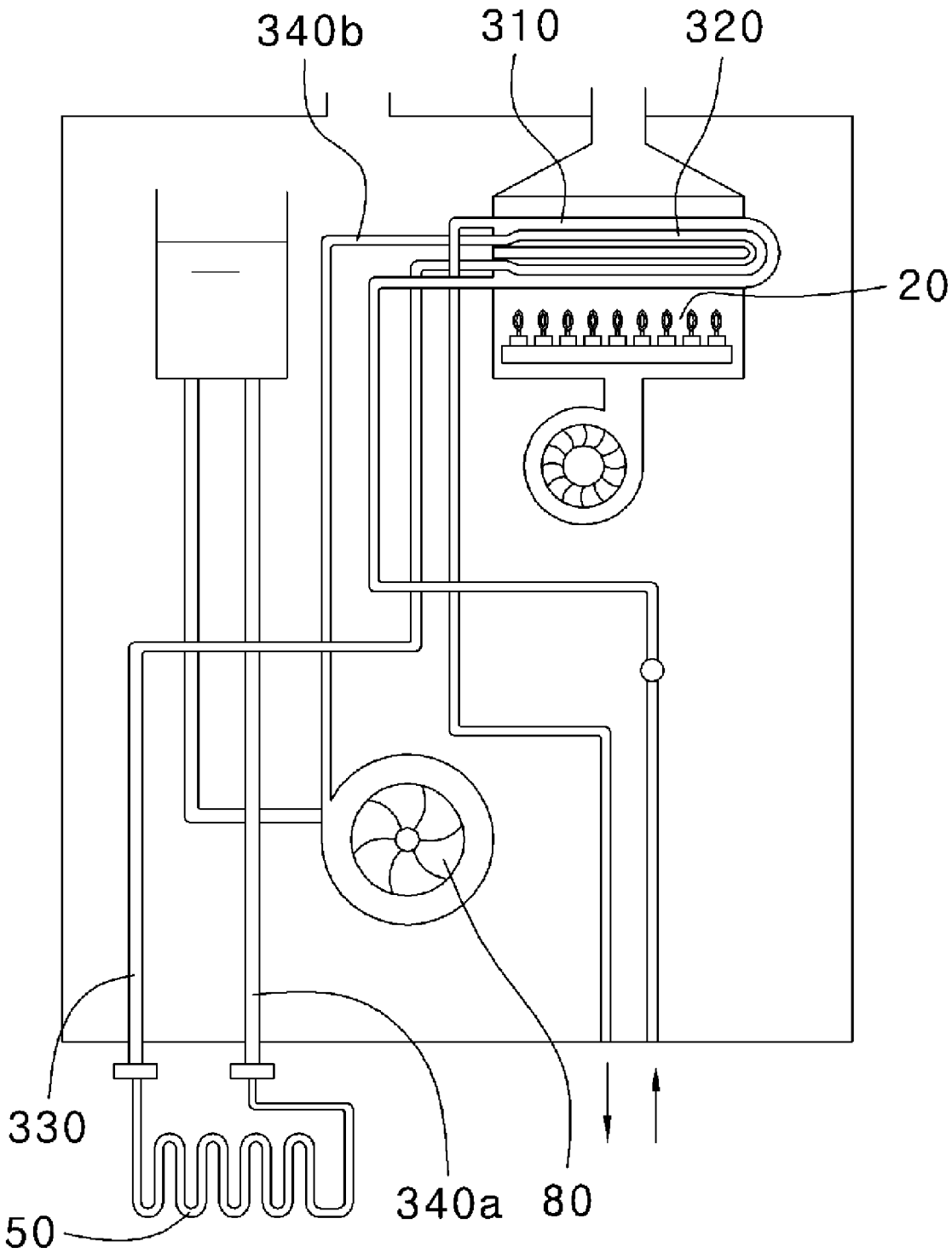
FIG. 4 is a view showing a configuration of a boiler having a heat exchanger according to the embodiment of the present invention.

FIG. 4 is a view showing a configuration of a boiler having a heat exchanger according to an embodiment of the present invention.

The heating water pathway of the instantaneous boiler for supplying heating water and hot water according to the present invention is formed by connecting the inner pipe 320 of the heat exchanger, a heating water supplying pipe 330, a heating water line 50, and a heating water returning pipe 340 in series, as shown in FIG. 4. Thus, the boiler has a structure in which an operation of a circulation pump 80 is unnecessary during supply of hot water.

First, the double pipe heat exchanger includes an outer pipe 310 used for hot water pathway and an inner pipe 320 used for heating water pathway. The inner pipe 320 used for the heating water pathway is sequentially connected to the heating water supplying pipe 330, the heating water line 50, and the heating water returning pipe 340*a*. Further, the heating water returning pipe 340*b* connected to the circulation pump 80 is sequentially connected to the inner pipe 320 of the heat exchanger in series so as to circulate the heating water in a closed circuit.

Hereinafter, the operation of the boiler according to the present invention with the above-mentioned structure will be described. The boiler operates in the same way as an instantaneous water heater at time when only hot water is supplied. Specifically, the combustion heat of the burner 20 is directly transferred to the hot water pathway passing through the outer pipe 310 of the double pipe so as to heat water. In this case, the circulation pump 80 does not operate.

The circulation pump 80 operates and transfers heat energy of the outer pipe 310 to heating water pathway through the inner pipe 320 at a time when only heating water is supplied. Then, the heat energy is transferred to the heating water line 50 to heat rooms.

In a case where heating water and hot water are simultaneously supplied, if quantity of heat to be required is less than the maximum output of hot water during the use of hot water, it is possible to enable the circulation pump 80 to circulate the hot water so that exceeding heat can be used for heating rooms.

Figure 1:
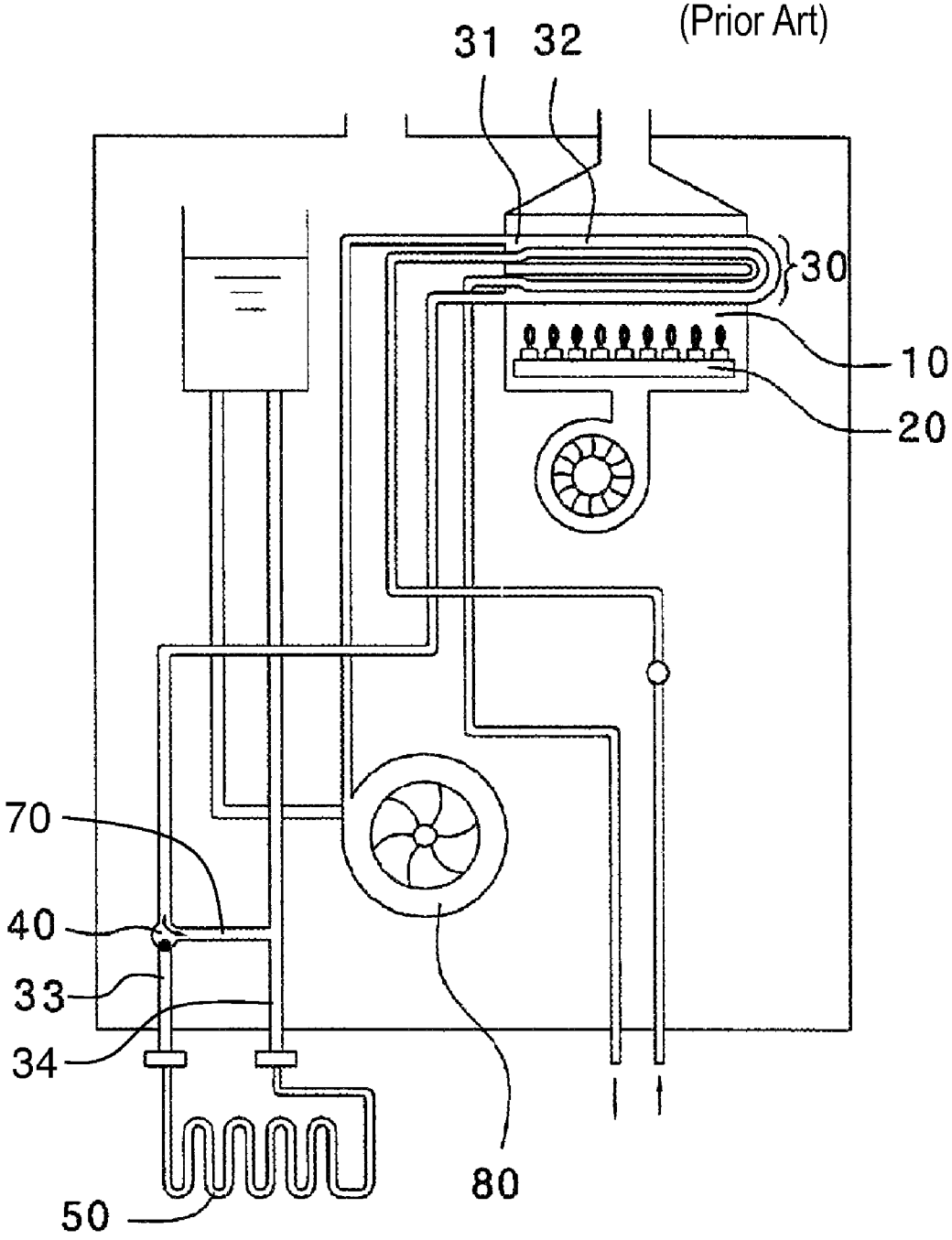
Fig. 1 (Prior Art)
FIG. 1 is a view showing a configuration of a conventional boiler having a double pipe heat exchanger.
Figure 2:
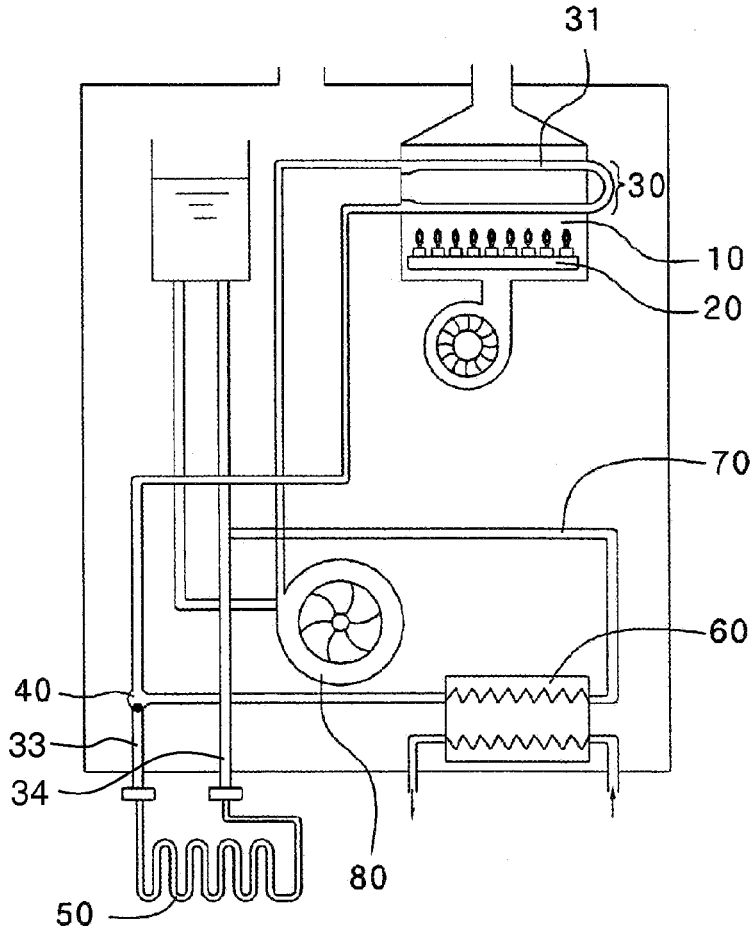
Fig. 2 (Prior Art)
FIG. 2 is a view showing a configuration of a conventional boiler having a single pipe heat exchanger.

According to the structure of the present invention, even though a three-way valve 40, an indirect heat exchanging line 70, and an indirect hot water heat exchanger 60 shown in FIGS. 1 and 2 are not mounted on the boiler, the use of hot water is possible. Further, the operation of the circulation pump 80 is unnecessary during supply of only hot water. There is an advantage in that the boiler has a compact structure.

INDUSTRIAL APPLICABILITY

As described above, the present invention can be applied to an instantaneous boiler for supplying heating water and hot water. Further, since a double pipe heat exchanger is provided with an outer pipe used for a hot water pathway and an inner pipe used for a heating water pathway, it is possible to obtain an output of hot water larger than an output of heating water, thereby simultaneously using heating water and hot water. In addition, since a three-way valve is not used, the boiler has a simple pipe arrangement structure, resulting in reduction of a manufacturing cost.

Although a preferred embodiment of the present invention has been described for illustrative purposes, those skilled in the art will appreciate that various modifications, additions and substitutions are possible, without departing from the scope and spirit of the invention as disclosed in the accompanying claims.

The invention claimed is:

1. A double pipe heat exchanger for an instantaneous boiler for supplying heating water and hot water, the heat exchanger comprising:

an outer pipe used for a hot water pathway, to which combustion heat is directly transferred from a burner in a combustion chamber;

an inner pipe used to a heating water pathway and extending through the outer pipe;

a heating water supply pipe connected to the inner pipe of the heat exchanger;

a heating water line connected to the heating water supply pipe; and a heating water returning pipe connected to the inner pipe, wherein the inner pipe of the heat exchanger, the heating water supply pipe, the heating water line, and the heating water returning pipe are connected to one another in series, and a circulation pump that is coupled to the inner pipe and is configured to operate (1) when only heating water is supplied and (2) if a quantity of heat to be required in the hot water is less than a maximum quantity of heat that can be supplied during use of the hot water, when both hot water and heating water are supplied.

2. The double pipe heat exchanger as claimed in claim 1, wherein the outer pipe has a plurality of fins attached to a peripheral surface of the outer pipe.

3. The double pipe heat exchanger as claimed in claim 1, wherein the inner pipe includes a straight type pipe, a multiple straight type pipe, a spiral type pipe, a coil type pipe, and a fin type pipe.

4. An instantaneous boiler for supplying heating water and hot water, the boiler comprising:

a heat exchanger including an outer pipe used for a hot water pathway, to which combustion heat is directly transferred from a burner in a combustion chamber, and an inner pipe used for a heating water pathway, which extends through the outer pipe;

a heating water supply pipe connected to the inner pipe of the heat changer;

a heating water line connected to the heating water supply pipe; and a heating water returning pipe connected to the inner pipe, wherein the inner pipe of the heat exchanger, the heating water supply pipe, the heating water line, and the heating water returning pipe are connected to one another in series, and a circulation pump that is coupled to the inner pipe and is configured to operate when only heating water is supplied and is configured to operate if a quantity of heat to be required in the hot water is less than a maximum quantity of heat that can be supplied during use of the hot water, when both hot water and heating water are supplied.

5. A controlling method of an instantaneous boiler for supplying heating water and hot water, the boiler comprising a heat exchanger including an outer pipe used for a hot water pathway, to which combustion heat is directly transferred from a burner in a combustion chamber, and an inner pipe used for a heating water pathway, which extends through the outer pipe, a heating water supply pipe connected to the inner pipe of the heat exchanger, a heating water line connected to the heating water supply pipe, a heating water returning pipe connected to the inner pipe, wherein the inner pipe of the heat exchanger, the heating water supply pipe, the heating water line, and the heating water returning pipe are connected to one another in series, and a circulation pump that is connected to the inner pipe, the method comprising operating the circulation pump when only heating water is supplied and when both hot water and heating water are supplied, a quantity of heat to be required in the hot water is less than a maximum quantity of heat that can be supplied during use of the hot water.

* * * * *